US005441473A

United States Patent [19]

Safani et al.

[11] Patent Number: 5,441,473

[45] Date of Patent: Aug. 15, 1995

[54] COMPACT BACK EXERCISER

[76] Inventors: Alan K. Safani, 15 W. 84th St., Apt. 5B, New York, N.Y. 10024; Roy Slack, 30595 NE. Trails End La., Newberg, Oreg. 97132

[21] Appl. No.: 153,829

[22] Filed: Nov. 16, 1993

[51] Int. Cl.[6] ..... A63B 21/04

[52] U.S. Cl. ..... 482/130; 482/140; 482/907; 482/142

[58] Field of Search ..... 482/130, 907, 142, 140, 482/129, 133, 100

[56] References Cited

U.S. PATENT DOCUMENTS

| | | | |
|---|---|---|---|
| 4,696,469 | 9/1987 | Elder | 482/142 |
| 5,042,801 | 8/1991 | Sterba et al. | 482/142 |
| 5,110,121 | 5/1992 | Foster | 482/142 |
| 5,147,267 | 9/1992 | Kunewalder | 482/142 |
| 5,215,511 | 6/1993 | Cheng | 482/142 |
| 5,256,126 | 10/1993 | Grotstein | 482/142 |

*Primary Examiner*—Lynne A. Reichard

*Attorney, Agent, or Firm*—Ostrolenk, Faber, Gerb & Soffen

[57] ABSTRACT

An exercising machine for the back which is simple, compact, economical and suited for home use includes a base which is constructed to lie flat on the floor. Included in this base is a seat upon which the user sits while leaning back against a pivoting arm. The pivoting arm has a resistance device which provides resistance to backward motion so as to work the muscles of the back. The pivoting arm is shaped to lie down flat when not in use, in a space defined by the base, creating a compact, substantially rectangular unit which is easy to handle and store.

15 Claims, 1 Drawing Sheet

42
10
14
44
24
12B
30
22
40
28
32
12A
11
26
16
18
20
44

44
12B
30
24
40
42
32
12A
26
22
18
20

14
14'
10
14"
32
22
26
20
42
12A
40
24

COMPACT BACK EXERCISER

BACKGROUND OF THE INVENTION

1. Field of the Invention

The present invention relates to exercise machines, and more particularly, to an exercise machine which is adapted to strengthen and work the muscles of the back and which is compact and easy to store.

2. Related Prior Art

Many devices for exercising various parts of the body are available for commercial and home use. These devices are adapted to guide the body in a specific repetitive motion against a resistance in order to exercise the intended part of the body.

Typical back exercising devices are shown in U.S. Pat. Nos. 3,545,748; 4,314,697; 4,623,144; 4,627,619; 4,666,152; 4,750,741; 4,763,897; 4,818,018; 4,834,396; 4,836,536; 4,854,578; 4,893,812; 5,100,131; 5,110,121; 5,110,122; 5,135,216; and Des. 299,257.

Many exercise devices require a significant amount of storage space when not in use. This is particularly a problem for exercise devices designed to be used in the home, especially in small homes or apartments where space is at a premium. As a result, substantial areas within a home may be devoted to storage of exercise equipment, greatly restricting alternative uses of these areas.

SUMMARY OF THE INVENTION

It is therefore an object of the invention to provide an exercise device, particularly for exercising the back, which is compact and easy to store. The present invention provides a simple, economical apparatus for exercising the muscles of the back which may be folded into a compact unit when not in use.

A seat is provided for supporting the user in comfort. In the disclosed embodiment, the seat is made of wood and shaped to receive a seated person. In the alternative, the seat may be constructed of plastic or any other suitable material. Further, the seat may not necessarily be formed, but may be flat.

According to the disclosed embodiment of the invention, the device comprises a base which is constructed to lie flat on the floor. Included within this base is a seat upon which the user can sit while leaning backward against a pivoting arm. The seat is provided with a seat belt to hold the user's body stationary while exercising, thus concentrating the user's effort on the desired muscle group.

A pivotable arm, connected to a variable resistance, engages the back so as to provide a force against which the back muscles are worked. Padding on the pivotable arm is provided to avoid discomfort while in contact with the user's back during the exercising motion. The pivotable arm is configured to fold flat and nest with the base when not in use to form a compact unit.

The pivotable arm advantageously has a two-position resistance member which provides variable impedance for working the muscles of the back. The arm is shaped to lie down flat in a space defined by the base when not in use. This creates a compact, substantially rectangular unit which is easy to handle and store, under a bed or hanging in a closet, for example.

Other features and advantages of the present invention will become apparent from the following description of an embodiment of the invention, which refers to the accompanying drawings.

DESCRIPTION OF AN ILLUSTRATIVE EMBODIMENT

Figure 1:
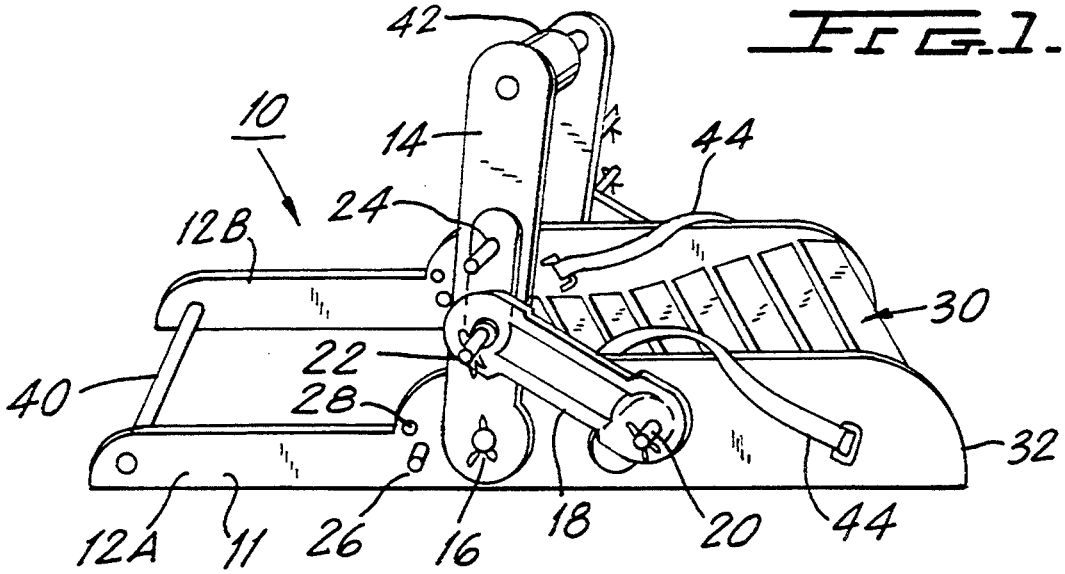
FIG. 1 is a side perspective view of a back exercising apparatus according to an embodiment of the present invention.

Referring to the Figures, the apparatus 10 of the present invention has a base 11 with sides 12A and 12B, and an arm 14 pivotally mounted thereto at a pivot point 16. For simplicity, only side 12A will be described, it being understood that both sides 12A and 12B may have the same components.

A resistance 18 such as conventional elastic or rubber spring is attached at pin 20 to side 12A of base 11, and is attached to arm 14 at pin 22. Also illustrated is a pin 24 on arm 14, which is another point where the resistance 18 may be attached. When resistance 18 is attached to pin 24 instead of pin 22, the resistance is increased, thus making the back muscles work harder during the exercise. A stop 26 is inserted into a hole in side 12A of base 11, which prevents arm 14 from rotating past a predetermined limit of the desired exercise motion. The stop 26 may alternatively be inserted into another hole 28, thereby providing a different limit of motion. The predetermined limit of motion may advantageously be an equilibrium point of the arm 14, beyond which the arm 14 should not move, in order to avoid the arm being drawn counter-clockwise by the resistance and locking in a downward position against the base 11.

As indicated previously, both sides 12A, 12B of apparatus 10 are preferably similar so as to provide balance, both having pins 20, 22, and 24 for configuring resistances 18, and stops 26 for preventing over-rotation of arm 14.

Figure 2:
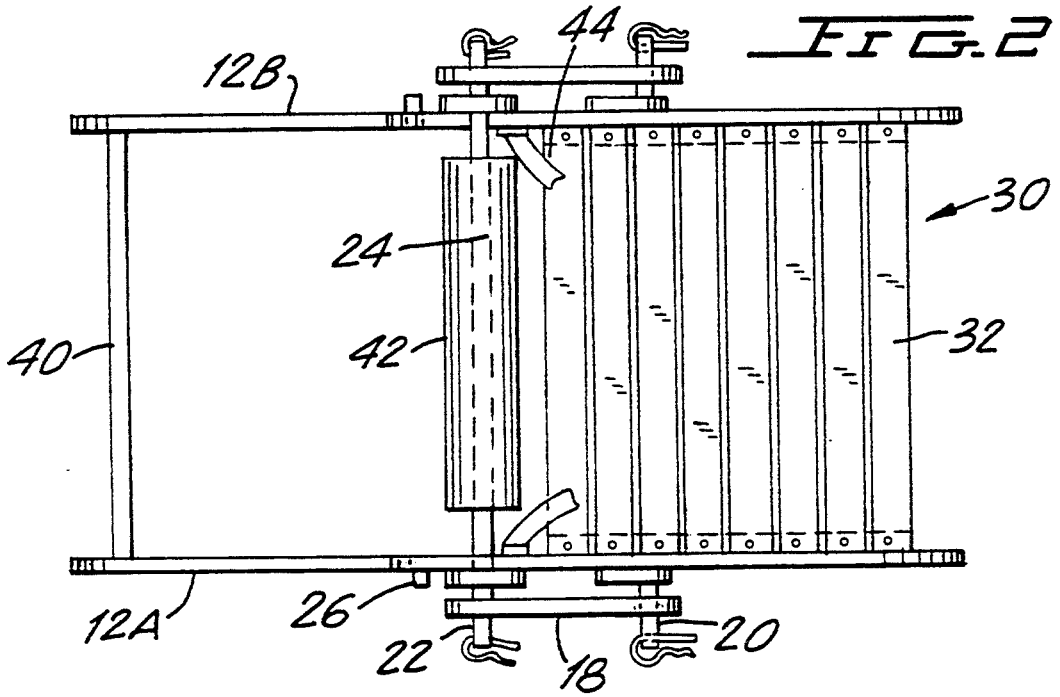
FIG. 2 is a top view of the apparatus of FIG. 1.

Referring now to FIG. 2, a top view of the apparatus at FIG. 1 is illustrated. As can be seen better from the top view, base 11 includes a seat 30 (FIG. 1) mounted on and between sides 12A and 12B. The seat 30 is preferably shaped for receiving the user in a comfortable sitting position. Seat 30 is arranged with a downward slope from one end 32 to approximately the center of the base 11, the low point of seat 30 being approximately at pivot point 16.

At the other end of base 11, sides 12A and 12B are connected by a rod 40 which maintains a separation between sides 12A and 12B. As illustrated, arm 14 contains a crosspiece 42 with a padded area upon which the user may lean and exert force to rotate arm 14 around pivot point 16. In the illustrated embodiment, the padded area may be made of neoprene rubber, for example, although any type of padding currently in use in the design of exercising equipment may be used.

Also illustrated is a seat belt 44 which the user may use to secure his or her waist to prevent forward slippage while the user leans backward to exert pressure on padded area 42. Seat belt 44 may be made of nylon or leather or another suitable material.

Seat 30 may be made of any material currently in use; for example, wooden slats are illustrated as providing maximum comfort. However, a molded plastic seat or a padded flat area may also be used.

Figure 3:
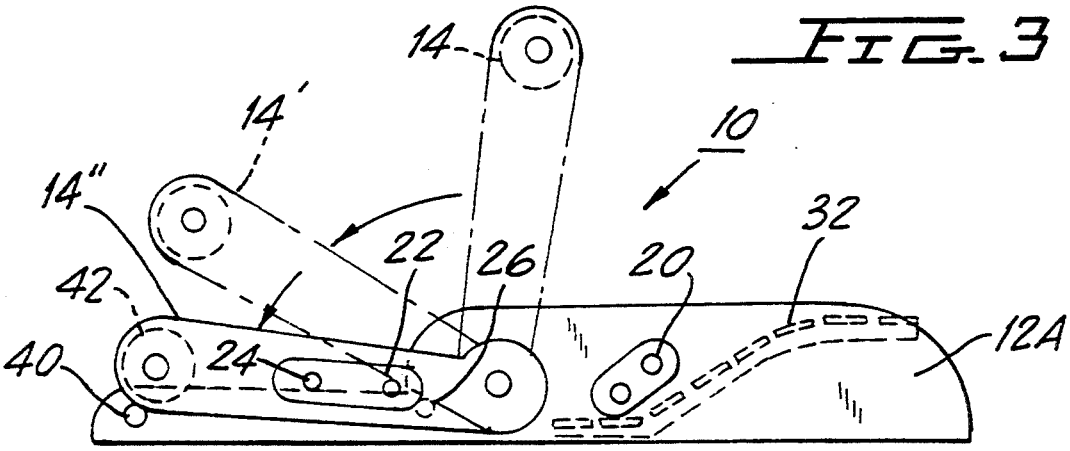
FIG. 3 is a side elevational view of the apparatus, showing movement of the pivoting arm in use, and its position in a folded state.

In operation, a user sits on the seat 30 and fastens seat belt 44 around the waist. The user then leans backward to exert pressure against crosspiece 42 with the upper or middle back, forcing arm 14 to rotate about pivot point 16, against the force exerted by resistance 18 as it stretches, until arm 14 reaches stop 26. In FIG. 3, 14 indicates the upright position of the arm, and 14' indicates the position of the arm after it has been pivoted backward to engage stop 26.

The user then rises slowly, using the muscles to provide resistance against the force of arm 14 as resistance 18 draws arm 14 back to an upright position. As indicated previously, the force of resistance 18 may be increased by connecting resistance 18 to pin 24 instead of pin 22 as the user progresses in back strength development.

In FIG. 3, 14" illustrates the position of the arm when the apparatus has been folded for storage. When exercising has been completed, resistance 18 may be disconnected at one end, either at pin 22 or 24, whichever pin was being used, or at pin 20. Resistance 18 may also be disconnected at both ends. It is preferable for resistance 18 to be disconnected from the pins 22, 24 located on arm 14 so that arm 14 will then be free to be folded backward to rest on rod 40. The stops 26 are removed. Arm 14 is then folded down against the sides 12A, 12B. In that position, arm 14 nests completely below the height of the tops of the sides 12A, 12B at their front ends adjacent to the seat 30, and the arm does not extend rearward beyond the rearward ends of the sides 12A, 12B. Thus, the arm 14 nests substantially completely within a space defined by the higher, front ends of the sides 12A, 12B, permitting the disclosed apparatus to be folded into a relatively flat compact, rectangular package which can easily slide under a bed for storage.

Holes (not shown) may be provided in the sides 12A and 12B for receiving the stops 26 at an appropriate location for holding the arm 14 in its folded-down storage position.

In an alternate embodiment, not shown herein but easily understandable from FIGS. 1–3, the arm 14 (specifically the two sides of the arm 14) may be mounted respectively to the inner sides rather than to the outer sides of the sides 12A, 12B. In that case the arm 14 will be completely within the sides 12A, 12B in its storage position, thereby providing an even more compact package when the arm 14 is folded down for storage.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An apparatus for exercising the back, comprising:
a base including a seat for a user;
a movable arm pivotally mounted at a position on said base, said arm having a crosspiece extending across said base for engaging the user's back; and
a resistance device associated with said base and said arm for providing a force which opposes pivoting exercise movement of said arm;
wherein said arm has a storage position; and
wherein a predetermined space is defined by a first portion of said base, and said arm is within said defined space when in said storage position.

2. The apparatus according to claim 1, further comprising means for varying the force provided by said resistance device in response to a given movement of said arm.

3. The apparatus according to claim 2, wherein said arm has a plurality of receiving means for receiving said resistance device, whereby a plurality of respective forces are provided by said resistance devices for a given movement of said arm.

4. The apparatus according to claim 1, further comprises a seat belt on said base for securing the user in the seat.

5. The apparatus according to claim 1, wherein said crosspiece is padded for comfortably engaging the back of the user.

6. The apparatus according to claim 1, further comprising a stop for limiting movement of said arm in said rearward direction.

7. The apparatus according to claim 6, wherein said stop is disengageable for permitting further movement in said rearward direction into said storage position.

8. The apparatus according to claim 1, wherein said arm has a pair of side pieces pivotally mounted to left and right sides of said base, respectively.

9. The apparatus according to claim 8, wherein said side pieces are mounted immediately adjacent to outside surfaces of said left and right sides of said base.

10. The apparatus according to claim 1, wherein the left and right sides of the base are defined by a pair of left and right side rails which define a substantially flat lower surface over substantially the entire length of the apparatus.

11. The apparatus according to claim 1, wherein said arm in its storage position is adjacent to a second portion of said base which is an extension of said first portion of said base.

12. An apparatus for exercising the back, comprising:
a base including a seat for a user;
a movable arm pivotally mounted at a position on said base, said arm having a crosspiece extending across said base for engaging the user's back; and
a resistance device associated with said base and said arm for providing a force which opposes pivoting exercise movement of said arm;
wherein said arm has a storage position; and
wherein said base has a first height at a first end thereof, and said arm in said storage position is completely below the height of the first end of the base, thereby being contained substantially completely within a space defined by the base.

13. The apparatus according to claim 12, wherein said arm has a pair of side pieces pivotally mounted to left and right sides of said base, respectively.

14. The apparatus according to claim 13, wherein said side pieces are mounted immediately adjacent to outside surfaces of said left and right sides of said base.

15. The apparatus according to claim 12, wherein said base has a second height at a second end thereof that is less than said first height, and said arm in its storage position is adjacent the second end of the base and completely below the height of the first end of the base.

* * * * *